United States Patent [19]

Hashimoto et al.

[11] Patent Number: 4,533,579

[45] Date of Patent: Aug. 6, 1985

[54] VIBRATION-RESISTANT, HEAT-INSULATING CASTING AND METHOD OF MAKING

[75] Inventors: Kametaro Hashimoto; Kenji Ushitani; Fumiyoshi Noda; Masahiko Sugiyama; Mikio Murachi, all of Toyota, Japan

[73] Assignee: Toyoda Jidosha Kogyo Kabushiki Kaisha, Toyoda, Japan

[21] Appl. No.: 423,172

[22] Filed: Sep. 24, 1982

Related U.S. Application Data

[60] Continuation of Ser. No. 317,340, Nov. 2, 1981, abandoned, which is a continuation of Ser. No. 161,404, Jun. 20, 1980, abandoned, which is a continuation of Ser. No. 924,348, Jul. 13, 1978, abandoned, which is a continuation of Ser. No. 715,977, Aug. 19, 1976, abandoned, which is a division of Ser. No. 559,882, Mar. 19, 1975, abandoned.

[30] Foreign Application Priority Data

Mar. 23, 1974 [JP] Japan ..... 49-32880

[51] Int. Cl.[3] ..... B22D 19/00

[52] U.S. Cl. ..... 428/36; 60/272; 60/282; 164/91; 164/98; 428/433; 428/469

[58] Field of Search ..... 164/98, 97, 91; 428/36, 428/450, 459, 613, 433, 469; 60/272, 282; 123/193; 501/7, 103, 118, 119, 127

[56] References Cited

U.S. PATENT DOCUMENTS

| | | | |
|---|---|---|---|
| 2,731,355 | 1/1956 | Skinner | 501/112 |
| 3,577,247 | 5/1971 | McKenna | 501/120 |
| 3,846,145 | 11/1974 | Roudabush | 501/107 |
| 3,863,701 | 2/1975 | Niimi et al. | 164/98 |
| 3,919,755 | 11/1975 | Kaneko et al. | 164/98 X |
| 3,991,166 | 11/1976 | Jack et al. | 501/98 X |
| 3,992,213 | 11/1976 | Desouches et al. | 501/105 |

FOREIGN PATENT DOCUMENTS

| | | | |
|---|---|---|---|
| 2163717 | 8/1972 | Fed. Rep. of Germany | 164/98 |
| 2354254 | 5/1974 | Fed. Rep. of Germany | 164/98 |

*Primary Examiner*—Nicholas P. Godici
*Assistant Examiner*—J. Reed Batten, Jr.
*Attorney, Agent, or Firm*—Quaintance & Murphy

[57] ABSTRACT

Ceramics adapted to be enveloped in a casting having a cumulative particle size distribution such that the percentage of particles with sizes of less than 44μ lies within the range of 14.5–50% and the balance consists of particles the maximum size of which ranges from 500–2,000μ, in order to produce vibration-resistant ceramic parts which may be enveloped in a casting.

14 Claims, 10 Drawing Figures

VIBRATION-RESISTANT, HEAT-INSULATING CASTING AND METHOD OF MAKING

This application is a continuation of U.S. Application Ser. No. 317,340, filed Nov. 2, 1981, which in turn is a continuation of Application Ser. No. 161,404, filed June 20, 1980, which in turn is a continuation of U.S. Application Ser. No. 924,348, filed July 13, 1978, which in turn is a continuation of U.S. Application Ser. No. 715,977, filed Aug. 19, 1976, which application is a division of Application Ser. No. 559,882, filed Mar. 19, 1975, all now abandoned.

BACKGROUND OF THE INVENTION

Various attempts have been made to produce heat-insulated castings by enveloping ceramic parts in aluminum or cast iron castings. Since the modulus of elasticity of ceramics is considerably higher than that of metal and the coefficient of expansion of ceramics is lower than that of metal, compressive stress is developed in the ceramics and tensile stress in the metal at the boundary between the ceramic part and the metal as the molten metal solidifies and shrinks during cooling. Consequently, either the ceramic part is crushed or the metal yields or breaks down under tension. Usually the ceramic part, being weaker than the metal, is crushed. To avoid such crushing, the surface of the ceramic part which comes into contact with the metal is provided with a layer of a porous substance, which is compressed when the ceramic is enveloped in the casting, thereby preventing the ceramic part from being crushed. This method has, however, drawbacks in that when the layer of porous substance is too thick, the casting-enveloped ceramic part has a poor self-supporting strength and fails when subjected to slight vibration; and when the layer of porous substance is too thin, the ceramic part is crushed. In this method, depending on the properties of the layer of porous substance or the size and shape of the ceramic part, the appropriate thickness of the layer of porous substance is supposed to be 0.1–0.3 mm for, say, a cylindrical ceramic part about 50 mm in diameter. It is, however, extremely difficult to provide a layer of a porous substance on the ceramic part, with the thickness of the layer controlled to within such a narrow range.

Another method of producing heat-insulated castings is available, according to which a heat-insulating material is adhesively secured around a pipe of heat-resistant metal and the pipe is enveloped in a casting. In this case, however, the heat insulation obtained is not so good, because of substantial heat conduction from the pipe. Moreover, a heat-resistant metal of poor formability increases the cost of production, for it is exceedingly difficult to produce a pipe of intricate configuration therefrom.

SUMMARY OF THE INVENTION

The present invention relates to ceramics for use in making ceramic parts when anti-vibration heat-insulated castings are to be produced by enveloping the ceramic part in an aluminum casting or in an iron casting for support.

DETAILED DESCRIPTION OF THE INVENTION

This invention relates to ceramics adapted to be enveloped in a casting, and more specifically to ceramic particles having a special size distribution, which can be molded and fired into vibration resistant ceramic parts.

The present inventors have discovered that, when a ceramic part is molded from ceramic particles having a special size distribution, a heat-insulated casting with excellent insulating and anti-vibration characteristics which does not break during envelopment casting can be obtained without modifying the structure and composition of the cast product as heretofore considered necessary.

To be specific, the present invention is directed to ceramics such as alumina ($Al_2O_3$), cordierite ($2MgO.2Al_2O_3.5SiO_2$), zirconia ($ZrO_2$), glass ceramic ($Li_2O.Al_2O_3.SiO_3$) having particle sizes ranging from a few $\mu$ to 2000$\mu$. To be more specific, it is directed to ceramics for envelopment casting characterized in that particles of less than 44$\mu$ in size account for 14.5–50% of the total, the balance being particles having a maximum size ranging from 500–2000$\mu$, as illustrated in the shaded range of cumulative particle size distribution in FIG. 4.

The ceramics according to the invention are such that, with the cumulative particle size distribution as illustrated above, the resulting mixture of various particles with different sizes can absorb the strain or stress of being enveloped in a casting, and is not restricted with respect to the form to be given to said casting. Thus, ceramic parts of any intricate configuration or any size can be successfully enveloped in castings, thereby permitting many different applications of the ceramic products.

For example, they may be used for keeping the exhaust gas passage in an automotive cylinder head warm, thereby making it possible to oxidize carbon monoxide or unburned hydrocarbons and turn them into harmless water or carbonic acid gas. Alternatively, they may be used for keeping the exhaust gas at the exhaust gas inlet of a manifold reactor serving as an auto emission purifier warm, thereby raising the temperature in the combustion chamber of the manifold reactor and improving the efficiency with which the carbon monoxide and unburned hydrocarbons in the exhaust gas are converted to harmless water or carbonic acid gas.

Next, test examples will be given to illustrate the effect of the present invention.

TEST EXAMPLE 1

Figure 1:
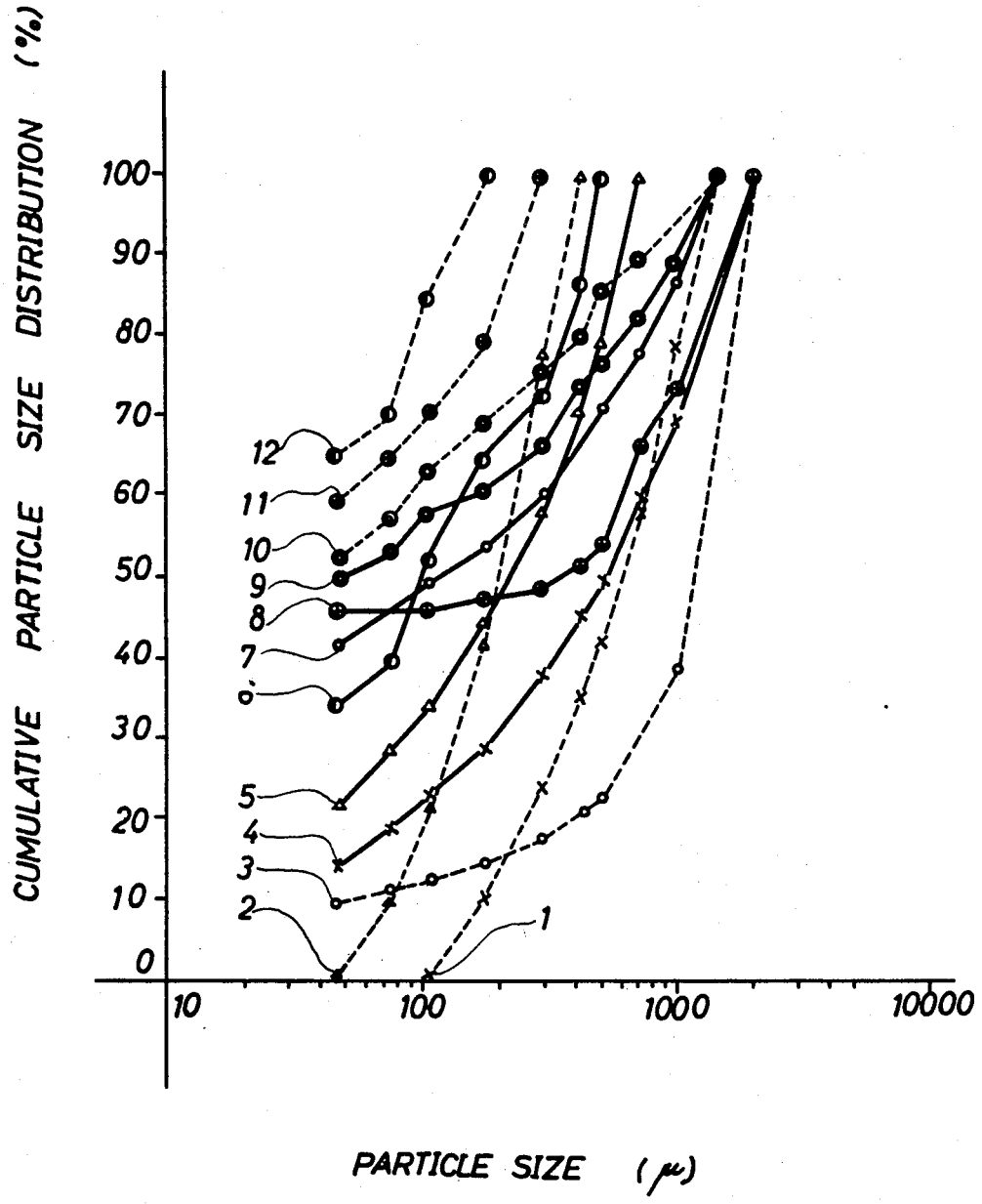
FIG. 1 is a diagram showing the cumulative particle size distribution in the ceramics employed in the test examples.

A pipe was fabricated from ceramic material having a cumulative particle size distribution as shown in FIG. 1. This pipe was enveloped in an aluminum alloy or iron casting and the resulting product was tested for castability and resistance to vibration. At the same time, certain specimens of ceramics were prepared and tested for their characteristics.

In the following are described the methods of molding and testing the ceramic pipes and the results thereof.

(1) Manufacture of ceramic pipe

(A) Materials

Ceramic particles of alumina ($Al_2O_3$) and cordierite ($2MgO.2Al_2O_3.5SiO_2$) were employed. As illustrated in FIG. 1 particles having a cumulative distribution of 12 different sizes were used. They had been obtained by sifting the particles to different sizes through a standard sieve (JIS Z 8801) and mixing them.

(B) Molding of ceramic pipe

The ceramic pipe was manufactured by compounding the ceramic particles with the following resin composition, kneading the product in a high-temperature kneader at 170°–190° C. for 1.5 hours, rolling it by means of a hot roll at a roll temperature of 130° C. into a sheet, crushing the sheet in a pelletizer and injection-molding the crushed products. The crushed products were then screened and particles more than 2.38 mm in size were again put through the pelletizer.

The resin composition was made of the following:

| | |
|---|---|
| Polystyrene (Styron 470 of Asahi-Dow Chemical) | 64.3% |
| Diethylphthalate | 10.7% |
| Stearic acid | 25% |

The ceramic and resin composition was compounded as follows:

| | |
|---|---|
| a. Case of alumina | |
| Alumina | 84% |
| Resin composition | 16% |
| (Note: The alumina contained 4% talc as a sintering additive. The alumina used was Showa-Denko's R Morandum W and the talc was made of material supplied by Seto Yogyo Genryo.) | |
| b. Case of cordierite | |
| Cordierite | 75% |
| Resin composition | 25% |
| (Note: The cordierite was one produced by Marusu Yugyo.) | |

Injection molding was carried out using a horizontal type injection molding machine (built by Meiki Seisakusho Ltd.) under the following conditions:

| | |
|---|---|
| Injection pressure | 800–1000 Kg/cm$^2$ |
| Injection temperature | 180° C. |
| Metal mold temperature | 25° C. |
| Gate | fan gate |

Allowing for shrinkage in the firing of the ceramics, the dimensions of the metal mold were set 5% smaller as to the inner diameter and 5% larger as to the outer diameter than the final dimensions of the pipe as listed in Table 1.

(C) Degreasing and firing of ceramic pipe

The resulting molded product was deburred, degreased and then fired.

For degreasing, one hour was taken to raise the temperature from the ambient temperature to 70° C., and 80 hours was taken to raise it from 80° C. to 320° C. at a rate of 3° C./hr., and air was blown into the degreasing furnace throughout this time.

After degreasing, the alumina pipe was fired at 1350°–1750° C. and the cordierite pipe was fired at 1150°–1350° C. The rate of temperature increase was set at 100° C./hr. and the firing time was set at 3 hours. The fired pipes were finished by a diamond grinder to the specified dimensions. As listed in Table 1, four types of pipes were produced.

(2) Cast-enveloping test

Figure 2:
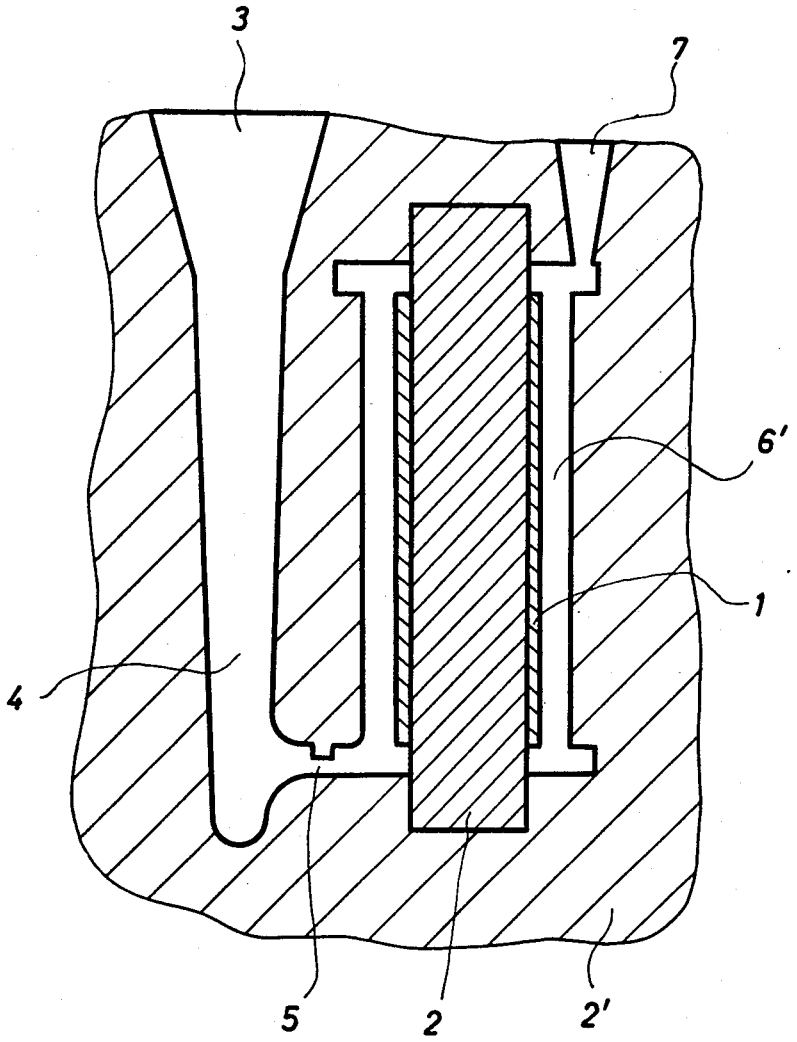
FIG. 2 is a sectional view of the casting mold used for envelopment casting.

The ceramic pipe 1 produced in this manner was provided with a $CO_2$ core 2 as illustrated in FIG. 2. This assembly was placed in a $CO_2$ cast mold 2'; and by pouring molten metal into the mold 2' the pipe was enveloped in a casting. In FIG. 2, reference numeral 3 indicates the gate, 4 the runner, 5 the parting gate, 6' the mold cavity, and 7 is the vent.

The casting enveloped product was finished to form the article shown in FIGS. 3*a* and 3*b* by demolding and machining. Reference numeral 6 indicates the cast envelope.

TABLE 1

Figure 3:
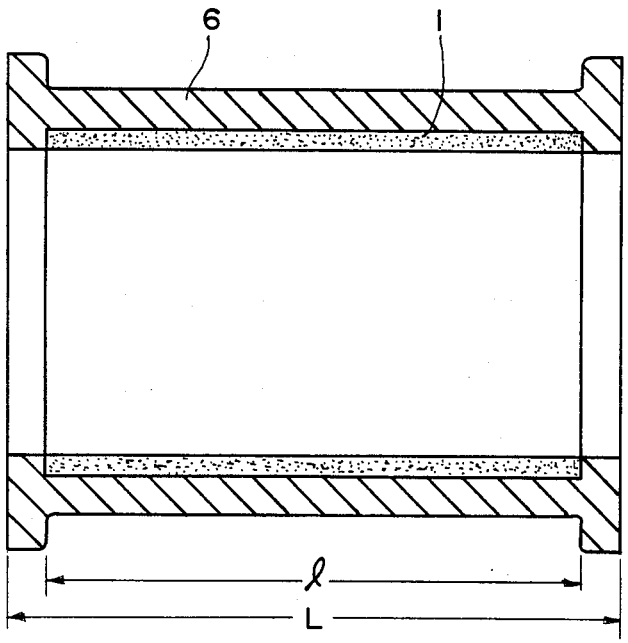
FIG. 3*a* is an axial sectional view of a heat-insulated casting, i.e., a ceramic pipe enveloped in a casting.
FIG. 3*b* is an end view of the casting shown in FIG. 3*a;*
Figure 3:
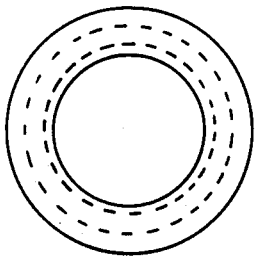

Dimensions of pipe and casting-enveloped pipe (see FIG. 3)

| | Ceramic pipe (mm) | | | Cast-enveloped pipe (mm) | | |
|---|---|---|---|---|---|---|
| Symbols | in. dia. (a) | out. dia. (b) | length (l) | out. dia. (c) | flange dia. (d) | length (L) |
| A | 40 mm | 50 mm | 150 mm | 70 mm | 90 mm | 170 mm |
| B | 30 | 50 | 150 | 70 | 90 | 170 |
| C | 90 | 100 | 150 | 120 | 140 | 170 |
| D | 80 | 100 | 150 | 120 | 140 | 170 |

(3) Vibration test

Four casting-enveloped products with different dimensions were tested for anti-vibration performance under the following conditions:

| | |
|---|---|
| Frequency of vibration | 90 Hz |
| Vibrational acceleration (amplitude) | 15G (0.92 mm)<br>30G (1.84 mm)<br>45G (2.76 mm) |
| Testing time | 60 min. |
| Vibrational direction | direction of diameter (L) of casting-enveloped product. |

(4) Measurement of ceramic part for bending strength and bulk density

In the same way as in the above production of ceramic pipes, test specimens, 40 mm long × 10 mm wide × 5 mm thick, were prepared and measured for bending strength and bulk density.

The bending test was performed with the span 30 cm and the loading speed 0.5 mm/min.

(5) Test results

Tables 3–17 summarize the results of the above-mentioned tests. The following symbols are used, the method of indication being the same in Table 23.

| | |
|---|---|
| For casting enveloping test | |
| ◎ | Casting-envelopable |
| ○ | Tiny cracks visible to the naked eye developing in the ceramic pipe |
| Δ | Wide cracks occurring in the ceramic pipe |
| X | Ceramic pipe broken |
| For vibration test | |
| ○ | Not broken |
| Δ | Signs of breaking |
| X | Ceramics totally broken |
| — | No test |

The left side of the tables refers to the results with an aluminm alloy-enveloped product and the right side to the results with a cast iron-enveloped product.

(a) Alumina pipe

The results given in Tables 3–14 indicate that the pipes using ceramic materials having cumulative particle size distributions Nos. 4–9 can be satisfactorily enveloped in casting with excellent anti-vibration characteristics.

Figure 4:
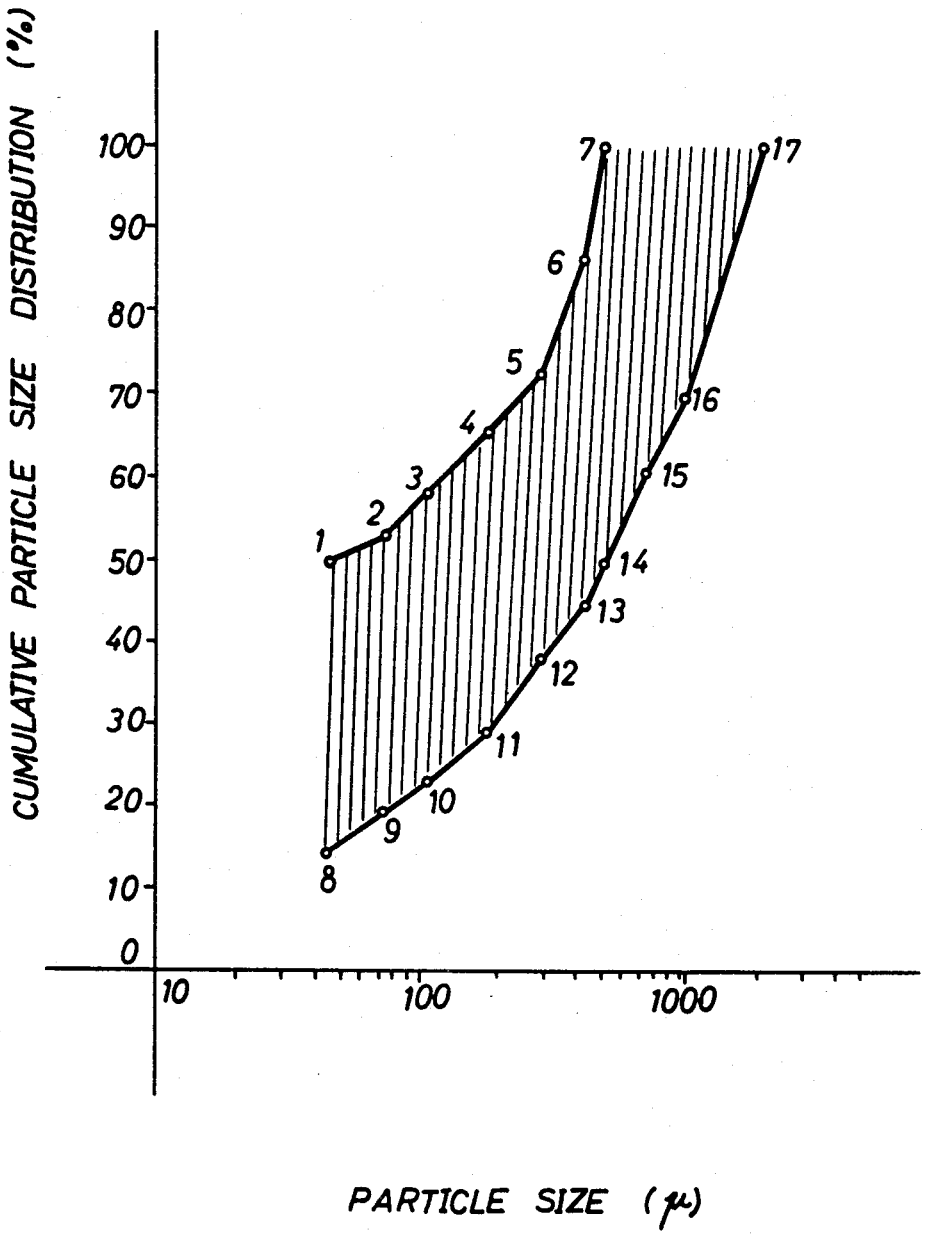
FIG. 4 is a diagram showing the cumulative range of particle sizes in the ceramic according to the invention.

From the above results it follows that in FIG. 4, showing the particle size vs. cumulative particle size distribution, the shaded area represents good performance.

Numerical values for each point in the shaded area of FIG. 4 are listed in Table 2.

TABLE 2

| No. | Particle size (μ) | Cumulative particle size distribution (%) |
|---|---|---|
| 1 | 44 | 50 |
| 2 | 74 | 53 |
| 3 | 105 | 58 |
| 4 | 177 | 65 |
| 5 | 297 | 72 |
| 6 | 420 | 86 |
| 7 | 500 | 100 |
| 8 | 44 | 14,5 |
| 9 | 74 | 19 |
| 10 | 105 | 23 |
| 11 | 177 | 29 |
| 12 | 297 | 38 |
| 13 | 400 | 45.5 |
| 14 | 500 | 49.5 |
| 15 | 707 | 60.5 |
| 16 | 1000 | 69 |
| 17 | 2000 | 100 |

(b) Cordierite pipe

Tables 15–17 summarize the results with respect to pipes using materials having cumulative particle size distributions No. 3, No. 7 and No. 10.

Since cordierite melts at 1400°–1450° C. and accordingly defies envelopment in cast iron, the envelopment test was done only with aluminum alloy.

From the test results listed in Tables 15–17, it is clear that in both the envelopment test and the vibration test, good results can be obtained only when the material is alumina ceramics.

TABLE 3

| | Test results with cumulative particle size Distribution No. 1 (alumina ceramics) | | | | | | | | | |
|---|---|---|---|---|---|---|---|---|---|---|
| | Firing temperature and shrinkage | | Bulk | Bending | Ceramic | Enveloping test results | | Vibration test results Vibrational acceleration | | |
| Tests No. | Firing temperature (°C.) | Linear shrinkage (%) | density (g/cm³) | strength (Kg/cm²) | pipe shape | Aluminum alloy | Cast iron | 15 G | 30 G | 45 G |
| 1-A | 1350 | 0 | 2.40 | 22.4 | A | ◎ | ◎ | × × | — | — |
| 1-B | | | | | B | ◎ | ◎ | × × | — | — |
| 1-C | | | | | C | ◎ | ◎ | × × | — | — |
| 1-D | | | | | D | ◎ | ◎ | × × | — | — |
| 2-A | 1450 | 0 | 2.42 | 74.6 | A | ◎ | ◎ | × × | — | — |
| 2-B | | | | | B | ◎ | ◎ | × × | — | — |
| 2-C | | | | | C | ◎ | ◎ | × × | — | — |
| 2-D | | | | | D | ◎ | ◎ | × × | — | — |
| 3-A | 1550 | 0 | 2.41 | 86.7 | A | ◎ | ◎ | Δ Δ | × — | — |
| 3-B | | | | | B | ◎ | ◎ | Δ Δ | × — | — |
| 3-C | | | | | C | ◎ | ◎ | Δ × | — | — |
| 3-D | | | | | D | ◎ | ◎ | Δ Δ | — | — |
| 4-A | 1600 | 0 | 2.42 | 134.6 | A | ◎ | ◎ | Δ Δ | × × | — |
| 4-B | | | | | B | ◎ | ◎ | Δ Δ | × × | — |
| 4-C | | | | | C | ◎ | Δ | Δ × | — | — |
| 4-D | | | | | D | Δ | Δ | × × | — | — |

TABLE 4

| | Test results with cumulative particle size Distribution No. 2 (alumina ceramics) | | | | | | | | | |
|---|---|---|---|---|---|---|---|---|---|---|
| | Firing temperature and shrinkage | | Bulk | Bending | Ceramic | Enveloping test results | | Vibration test results Vibrational acceleration | | |
| Tests No. | Firing temperature (°C.) | Linear shrinkage (%) | density (g/cm³) | strength (Kg/cm²) | pipe shape | Aluminum alloy | Cast iron | 15 G | 30 G | 45 G |
| 5-A | 1350 | 0 | 2.45 | 40.6 | A | ◎ | ◎ | × × | — | — |
| 5-B | | | | | B | ◎ | ◎ | × × | — | — |
| 5-C | | | | | C | ◎ | ◎ | × × | — | — |
| 5-D | | | | | D | ◎ | ◎ | × × | — | — |
| 6-A | 1450 | 0 | 2.44 | 93.4 | A | ◎ | ◎ | Δ Δ | × × | — |
| 6-B | | | | | B | ◎ | ◎ | Δ Δ | × × | — |

TABLE 4-continued

| Tests No. | Firing temperature and shrinkage: Firing temperature (°C.) | Firing temperature and shrinkage: Linear shrinkage (%) | Test results with cumulative particle size Distribution No. 2 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 6-C | | | | | C | ◎ | ◎ | Δ Δ | — | — |
| 6-D | | | | | D | ◎ | ◎ | Δ Δ | — | — |
| 7-A | 1550 | 0 | 2.46 | 141.0 | A | ◎ | ◎ | ○ ○ | Δ × | — |
| 7-C | | | | | C | ◎ | ◎ | ○ ○ | × × | — |
| 7-D | | | | | D | ◎ | ◎ | ○ ○ | × × | — |

TABLE 5

| Tests No. | Firing temperature and shrinkage: Firing temperature (°C.) | Firing temperature and shrinkage: Linear shrinkage (%) | Test results with cumulative particle size Distribution No. 3 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 8-A | 1350 | 0 | 2.46 | 52.3 | A | ◎ | ◎ | × × | — | — |
| 8-B | | | | | B | ◎ | ◎ | × × | — | — |
| 8-C | | | | | C | ◎ | ◎ | × × | — | — |
| 8-D | | | | | D | ◎ | ◎ | × × | — | — |
| 9-A | 1450 | 0 | 2.49 | 118.2 | A | ◎ | ◎ | ○ ○ | × × | — |
| 9-B | | | | | B | ◎ | ◎ | ○ ○ | × × | — |
| 9-C | | | | | C | ◎ | ◎ | ○ ○ | × × | — |
| 10-C | 1550 | 0 | 2.47 | 176.5 | C | ◎ | ◎ | ○ ○ | × × | — |
| 10-D | | | | | D | ◎ | ◎ | ○ ○ | × × | — |

TABLE 6

| Tests No. | Firing temperature and shrinkage: Firing temperature (°C.) | Firing temperature and shrinkage: Linear shrinkage (%) | Test results with cumulative particle size Distribution No. 4 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 11-A | 1450 | 0 | 2.51 | 130.4 | A | ◎ | ◎ | ○ ○ | ○ ○ | Δ Δ |
| 11-B | | | | | B | ◎ | ◎ | ○ ○ | ○ ○ | Δ Δ |
| 11-C | | | | | C | ◎ | ◎ | ○ ○ | Δ Δ | — |
| 11-D | | | | | D | ◎ | ◎ | ○ ○ | Δ Δ | — ○ |
| 12-A | 1550 | 0 | 2.49 | 181.0 | A | ◎ | ◎ | ○ ○ | ○ ○ | ○ |
| 12-B | | | | | B | ◎ | ◎ | ○ ○ | ○ | ○ ○ |
| 12-C | | | | | C | ◎ | ◎ | ○ ○ | ○ ○ | Δ Δ |
| 12-D | | | | | D | ◎ | ◎ | ○ ○ | ○ ○ | Δ Δ |
| 13-A | 1600 | 0.1 | 2.53 | 238.5 | A | ◎ | ◎ | ○ ○ | ○ ○ | ○ ○ |
| 13-B | | | | | B | ◎ | ◎ | ○ ○ | ○ ○ | ○ ○ |
| 13-C | | | | | C | ◎ | Δ | ○ ○ | Δ × | × — |
| 13-D | | | | | D | ◎ | Δ | ○ ○ | Δ × | — |

TABLE 7

| Tests No. | Firing temperature and shrinkage: Firing temperature (°C.) | Firing temperature and shrinkage: Linear shrinkage (%) | Test results with cumulative particle size Distribution No. 5 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 14-A | 1450 | 0 | 2.94 | 95.4 | A | ◎ | ◎ | ○ ○ | ○ ○ | Δ Δ |
| 14-B | | | | | B | ◎ | ◎ | ○ ○ | ○ ○ | Δ Δ |
| 14-C | | | | | C | ◎ | ◎ | ○ ○ | Δ Δ | — |
| 14-D | | | | | D | ◎ | ◎ | ○ ○ | Δ Δ | — |
| 15-A | 1550 | 0 | 2.52 | 159.4 | A | ◎ | ◎ | ○ ○ | ○ ○ | ○ ○ |
| 15-B | | | | | B | ◎ | ◎ | ○ ○ | ○ ○ | ○ ○ |
| 15-C | | | | | C | ◎ | ◎ | ○ ○ | ○ ○ | Δ Δ |
| 15-D | | | | | D | ◎ | ◎ | ○ ○ | ○ ○ | Δ × |
| 16-A | 1600 | 0.1 | 2.55 | 197.2 | A | ◎ | ◎ | ○ ○ | ○ ○ | ○ ○ |
| 16-B | | | | | B | ◎ | ○ | ○ ○ | ○ ○ | Δ × |
| 16-C | | | | | C | ○ | ○ | ○ ○ | ○ ○ | × × |
| 16-D | | | | | D | ○ | ○ | ○ ○ | ○ ○ | × × |

TABLE 8

Test results with cumulative particle size Distribution No. 6 (alumina ceramics)

| Tests No. | Firing temperature and shrinkage: Firing temperature (°C.) | Firing temperature and shrinkage: Linear shrinkage (%) | Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 17-A | 1350 | 0 | 2.52 | 94.6 | A | ◎ | ◎ | | △△ | — |
| 17-B | | | | | B | ◎ | ◎ | | △△ | — |
| 17-C | | | | | C | ◎ | ◎ | | △△ | — |
| 17-D | | | | | D | ◎ | ◎ | | △△ | — |
| 18-A | 1450 | 0 | 2.51 | 115.2 | A | ◎ | ◎ | | ○○ | ○○ |
| 18-B | | | | | B | ◎ | ◎ | | ○○ | ○○ |
| 18-C | | | | | C | ◎ | ◎ | | ○○ | △△ |
| 18-D | | | | | D | ◎ | ◎ | | ○○ | △△ |
| 19-A | 1550 | 0 | 2.53 | 157.2 | A | ◎ | ◎ | | ○○ | ○○ |
| 19-B | | | | | B | ◎ | ◎ | | ○○ | ○○ |
| 19-C | | | | | C | ◎ | ◎ | | ○○ | ○○ |
| 19-D | | | | | D | ◎ | ◎ | | ○○ | ○○ |
| 20-A | 1600 | 0.2 | 2.55 | 195.4 | A | ◎ | ◎ | | ○○ | ○○ |
| 20-B | | | | | B | ◎ | ◎ | | ○○ | ○○ |
| 20-C | | | | | C | ○ | ○ | | ○○ | △△ |
| 20-D | | | | | D | ○ | ○ | | ○○ | △△ |

TABLE 9

Test results with cumulative particle size Distribution No. 7 (alumina ceramics)

| Tests No. | Firing temperature and shrinkage: Firing temperature (°C.) | Firing temperature and shrinkage: Linear shrinkage (%) | Bulk density (g/cm³) | Bending strength (Kg/cm²) | Ceramic pipe shape | Enveloping test results: Alumunum alloy | Enveloping test results: Cast iron | Vibration test results, Vibrational acceleration: 15 G | 30 G | 45 G |
|---|---|---|---|---|---|---|---|---|---|---|
| 21-A | 1350 | 0 | 2.51 | 93.1 | A | ◎ | ◎ | ○○ | ○○ | ×× |
| 21-B | | | | | B | ◎ | ◎ | ○○ | ○○ | ×× |
| 21-C | | | | | C | ◎ | ◎ | ○○ | △△ | ×× |
| 21-D | | | | | D | ◎ | ◎ | ○○ | △△ | ×× |
| 22-A | 1450 | 0 | 2.50 | 153.2 | A | ◎ | ◎ | ○○ | ○○ | ○○ |
| 22-B | | | | | B | ◎ | ◎ | ○○ | ○○ | ○○ |
| 22-C | | | | | C | ◎ | ◎ | ○○ | ○○ | ○○ |
| 22-D | | | | | D | ◎ | ◎ | ○○ | ○○ | ○○ |
| 23-A | 1550 | 0 | 2.53 | 204.2 | A | ◎ | ◎ | ○○ | ○○ | ○○ |
| 23-B | | | | | B | ◎ | ◎ | ○○ | ○○ | ○○ |
| 23-C | | | | | C | ◎ | ◎ | ○○ | ○○ | ○○ |
| 23-D | | | | | D | ◎ | ◎ | ○○ | ○○ | ○○ |
| 24-A | 1600 | 0 | 2.52 | 250.0 | A | ◎ | ◎ | ○○ | ○○ | ○○ |
| 24-B | | | | | B | ◎ | ◎ | ○○ | ○○ | ○○ |
| 24-C | | | | | C | ◎ | ◎ | ○○ | ○○ | ○○ |
| 24-D | | | | | D | ◎ | ○ | ○○ | ○○ | ○○ |
| 25-A | 1650 | 0.2 | 2.54 | 364.6 | A | ○ | ○ | ○○ | ○○ | △△ |
| 25-B | | | | | B | ○ | ○ | ○○ | ○○ | △△ |
| 25-C | | | | | C | △ | △ | △△ | — | — |
| 25-D | | | | | D | △ | △ | △× | — | — |

TABLE 10

Test results with cumulative particle size Distribution No. 8 (alumina ceramics)

| Tests No. | Firing temperature and shrinkage: Firing temperature (°C.) | Firing temperature and shrinkage: Linear shrinkage (%) | Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 26-A | 1350 | 0 | 2.49 | 86.2 | A | ◎ | ◎ | | ○○ | ×× |
| 26-B | | | | | B | ◎ | ◎ | | ○○ | ×× |
| 26-C | | | | | C | ◎ | ◎ | | △△ | — |
| 26-D | | | | | D | ◎ | ◎ | | △△ | — |
| 27-A | 1450 | 0 | 2.48 | 138.5 | A | ◎ | ◎ | | ○○ | ○○ |
| 27-B | | | | | B | ◎ | ◎ | | ○○ | ○○ |
| 27-C | | | | | C | ◎ | ◎ | | ○○ | ○○ |
| 27-D | | | | | D | ◎ | ◎ | | ○○ | ○○ |
| 28-A | 1550 | 0 | 2.50 | 166.5 | A | ◎ | ◎ | | ○○ | ○○ |
| 28-B | | | | | B | ◎ | ◎ | | ○○ | ○○ |
| 28-C | | | | | C | ◎ | ◎ | | ○○ | ○○ |
| 28-D | | | | | D | ◎ | ◎ | | ○○ | ○○ |
| 29-A | 1600 | 0 | 2.51 | 193.1 | A | ◎ | ◎ | | ○○ | ○○ |
| 29-B | | | | | B | ◎ | ◎ | | ○○ | ○○ |
| 29-C | | | | | C | ◎ | ◎ | | ○○ | ○○ |
| 29-D | | | | | D | ○ | ○ | | ○○ | ○○ |
| 30-A | 1650 | 0.3 | 2.54 | 271.3 | A | ○ | ○ | | ○○ | △△ |

TABLE 10-continued

| Tests No. | Firing temperature and shrinkage: Firing temperature (°C.) | Firing temperature and shrinkage: Linear shrinkage (%) | Test results with cumulative particle size Distribution No. 8 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 30-B | | | | | B | ○ | ○ | | Δ Δ | Δ Δ |
| 30-C | | | | | C | Δ | Δ | × × | — | — |
| 30-D | | | | | D | × | × | — | — | — |

TABLE 11

| Tests No. | Firing temperature and shrinkage: Firing temperature (°C.) | Firing temperature and shrinkage: Linear shrinkage (%) | Test results with cumulative particle size Distribution No. 9 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 31-A | 1350 | 0 | 2.55 | 67.3 | A | ◎ | ◎ | ○ ○ | ○○ | × × |
| 31-B | | | | | B | ◎ | ◎ | ○ ○ | ○○ | × × |
| 31-C | | | | | C | ◎ | ◎ | ○ ○ | Δ Δ | — |
| 31-D | | | | | D | ◎ | ◎ | ○ ○ | Δ Δ | — |
| 32-A | 1450 | 0 | 2.58 | 135.5 | A | ◎ | ◎ | ○ ○ | ○○ | ○ ○ |
| 32-B | | | | | B | ◎ | ◎ | ○ ○ | ○ ○ | ○ ○ |
| 32-C | | | | | C | ◎ | ◎ | ○ ○ | ○ ○ | ○ ○ |
| 32-D | | | | | D | ◎ | ◎ | ○ ○ | ○ ○ | ○ ○ |
| 33-A | 1550 | 0 | 2.59 | 171.3 | A | ◎ | ◎ | ○ ○ | ○ ○ | ○ ○ |
| 33-B | | | | | B | ○ | ○ | ○ ○ | ○ ○ | ○ ○ |
| 33-C | | | | | C | ○ | ○ | ○ ○ | ○ ○ | Δ Δ |
| 33-D | | | | | D | ○ | ○ | ○ ○ | ○ ○ | Δ Δ |
| 34-A | 1600 | 0.4 | 2.60 | 240.0 | A | ○ | ○ | ○ ○ | ○ ○ | ○ Δ |

TABLE 12

| Tests No. | Firing temperature and shrinkage: Firing temperature (°C.) | Firing temperature and shrinkage: Linear shrinkage (%) | Test results with cumulative particle size Distribution No. 10 (alumina ceramics): Bulk density (g/cm³) | Bending strength (Kg/cm²) | Ceramic pipe shape | Enveloping test results: Alumina alloy | Enveloping test results: Cast iron | Vibration test results, Vibrational acceleration: 15 G | 30 G | 45 G |
|---|---|---|---|---|---|---|---|---|---|---|
| 35-A | 1450 | 0 | 2.59 | 77.5 | A | ◎ | ◎ | ○ ○ | — | — |
| 35-B | | | | | B | ◎ | ◎ | ○ ○ | — | — |
| 35-C | | | | | C | ○ | ○ | ○ ○ | — | — |
| 35-D | | | | | D | ○ | ○ | Δ Δ | — | — |
| 36-A | 1550 | 0.4 | 2.60 | 122.0 | A | Δ | Δ | × × | — | — |
| 36-B | | | | | B | Δ | Δ | × × | — | — |
| 36-C | | | | | C | × | × | — | — | — |
| 36-D | | | | | D | × | × | — | — | — |
| 37-A | 1600 | 0.7 | 2.63 | 201.4 | A | × | × | — | — | — |
| 37-B | | | | | B | × | × | — | — | — |
| 37-C | | | | | C | × | × | — | — | — |
| 37-D | | | | | D | × | × | — | — | — |

TABLE 13

| Tests No. | Firing temperature and shrinkage: Firing temperature (°C.) | Firing temperature and shrinkage: Linear shrinkage (%) | Test results with cumulative particle size Distribution No. 11 (alumina ceramics): Bulk density (g/cm³) | Bending strength (Kg/cm²) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| 38-A | 1350 | 0 | 2.64 | 40.1 | A | ○ | ○ | Δ Δ | — | — |
| 38-B | | | | | B | ○ | ○ | Δ Δ | — | — |
| 38-C | | | | | C | Δ | Δ | — | — | — |
| 38-D | | | | | D | Δ | Δ | — | — | — |
| 39-A | 1450 | 0 | 2.66 | 88.0 | A | × | × | — | — | — |
| 39-B | | | | | B | × | × | — | — | — |
| 39-C | | | | | C | × | × | — | — | — |
| 39-D | | | | | D | × | × | — | — | — |
| 40-A | 1550 | 0.2 | 2.69 | 179.3 | A | × | × | — | — | — |
| 40-B | | | | | B | × | × | — | — | — |
| 40-C | | | | | C | × | × | — | — | — |
| 40-D | | | | | D | × | × | — | — | — |

TABLE 14

| Tests No. | Firing temperature and shrinkage: Firing temperature (°C.) | Firing temperature and shrinkage: Linear shrinkage (%) | Bulk density ($g/cm^3$) | Bending strength ($Kg/cm^2$) | Ceramic pipe shape | Enveloping test results: Aluminum alloy | Enveloping test results: Cast iron | Vibration test results, Vibrational acceleration: 15 G | 30 G | 45 G |
|---|---|---|---|---|---|---|---|---|---|---|
| | Test results with cumulative particle size Distribution No. 12 (alumina ceramics) | | | | | | | | | |
| 41-A | 1350 | 0 | 2.70 | 53.9 | A | Δ | Δ | — | — | — |
| 41-B | | | | | B | Δ | Δ | — | — | — |
| 41-C | | | | | C | × | × | — | — | — |
| 41-D | | | | | D | × | × | — | — | — |
| 42-A | 1450 | 0 | 2.69 | 103.6 | A | × | × | — | — | — |
| 42-B | | | | | B | × | × | — | — | — |
| 42-C | | | | | C | × | × | — | — | — |
| 42-D | | | | | D | × | × | — | — | — |
| 43-A | 1550 | 0.2 | 2.71 | 161.2 | A | × | × | — | — | — |
| 43-B | | | | | B | × | × | — | — | — |
| 43-C | | | | | C | × | × | — | — | — |
| 43-D | | | | | D | × | × | — | — | — |

TABLE 15

| Tests No. | Firing temperature and shrinkage: Firing temperature (°C.) | Firing temperature and shrinkage: Linear shrinkage (%) | Bulk density ($g/cm^3$) | Bending strength ($Kg/cm^2$) | Ceramic pipe shape | Enveloping test results: Aluminum alloy | Vibration test results, Vibrational acceleration: 15 G | 30 G | 45 G |
|---|---|---|---|---|---|---|---|---|---|
| | Test results with cumulative particle size Distribution No. 3 (cordierite ceramics) | | | | | | | | |
| 44-A | 1150 | 0 | 1.66 | 39.9 | A | ◎ | ○ | × | — |
| 44-B | | | | | B | ◎ | ○ | × | — |
| 44-C | | | | | C | ◎ | ○ | × | — |
| 44-D | | | | | D | ◎ | ○ | × | — |
| 45-A | 1200 | 0.3 | 1.72 | 88.8 | A | ◎ | ○ | × | — |
| 45-B | | | | | B | ◎ | ○ | × | — |
| 45-C | | | | | C | ◎ | ○ | × | — |
| 45-D | | | | | D | ○ | ○ | × | — |
| 46-A | 1250 | 0.8 | 1.78 | 192.4 | A | ○ | ○ | × | — |
| 46-B | | | | | B | ○ | ○ | × | — |

TABLE 16

| Tests No. | Firing temperature and shrinkage: Firing temperature (°C.) | Firing temperature and shrinkage: Linear shrinkage (%) | Bulk density ($g/cm^3$) | Bending strength ($Kg/cm^2$) | Ceramic pipe shape | Enveloping test results: Aluminum alloy | Vibration test results, Vibrational acceleration: 15 G | 30 G | 45 G |
|---|---|---|---|---|---|---|---|---|---|
| | Test results with cumulative particle size Distribution No. 7 (cordierite ceramics) | | | | | | | | |
| 47-A | 1100 | 0 | 1.72 | 47.8 | A | ◎ | ○ | ○ | × |
| 47-B | | | | | B | ◎ | ○ | ○ | × |
| 47-C | | | | | C | ◎ | ○ | Δ | × |
| 47-D | | | | | D | ◎ | ○ | Δ | × |
| 48-A | 1150 | 0 | 1.70 | 93.4 | A | ◎ | ○ | ○ | ○ |
| 48-B | | | | | B | ◎ | ○ | ○ | ○ |
| 48-C | | | | | C | ◎ | ○ | ○ | ○ |
| 48-D | | | | | D | ◎ | ○ | ○ | ○ |
| 49-A | 1200 | 0.1 | 1.73 | 155.6 | A | ◎ | ○ | ○ | ○ |
| 49-B | | | | | B | ◎ | ○ | | |
| 49-C | | | | | C | ◎ | ○ | ○ | ○ |
| 49-D | | | | | D | ◎ | ○ | ○ | ○ |
| 50-A | 1250 | 0.5 | 1.78 | 265.8 | A | ◎ | ○ | ○ | ○ |
| 50-B | | | | | B | ◎ | ○ | ○ | ○ |
| 50-C | | | | | C | ◎ | ○ | ○ | ○ |
| 50-D | | | | | D | ◎ | ○ | ○ | ○ |
| 51-A | 1300 | 1.4 | 1.82 | 373,6 | A | ○ | ○ | ○ | ○ |
| 51-B | | | | | B | ○ | ○ | ○ | ○ |
| 51-C | | | | | C | ○ | ○ | Δ | × |

TABLE 17

| Tests No. | Firing temperature and shrinkage: Firing temperature (°C.) | Linear shrinkage (%) | Bulk density (g/cm³) | Bending strength (Kg/cm²) | Ceramic pipe shape | Enveloping test results Aluminum alloy | Vibration test results, Vibrational acceleration: 15 G | 30 G | 45 G |
|---|---|---|---|---|---|---|---|---|---|
| | Test results with cumulative particle size Distribution No. 10 (cordierite ceramics) | | | | | | | | |
| 52-A | 1100 | 0 | 1.82 | 41.7 | A | ◎ | ○ | × | — |
| 52-B | | | | | B | ◎ | ○ | × | — |
| 52-C | | | | | C | ◎ | ○ | × | — |
| 52-D | | | | | D | ◎ | ○ | × | — |
| 53-A | 1150 | 0 | 1.85 | 62.4 | A | ◎ | ○ | × | — |
| 53-B | | | | | B | ◎ | ○ | × | — |

The following are examples of practical uses for heat-insulated castings produced by envelopment of the invented ceramic parts.

EXAMPLE 1

A ceramic pipe using the ceramic material of the present invention was cast into the cylinder head of auto engine and submitted to an endurnace test on the engine stand.

Figure 5:
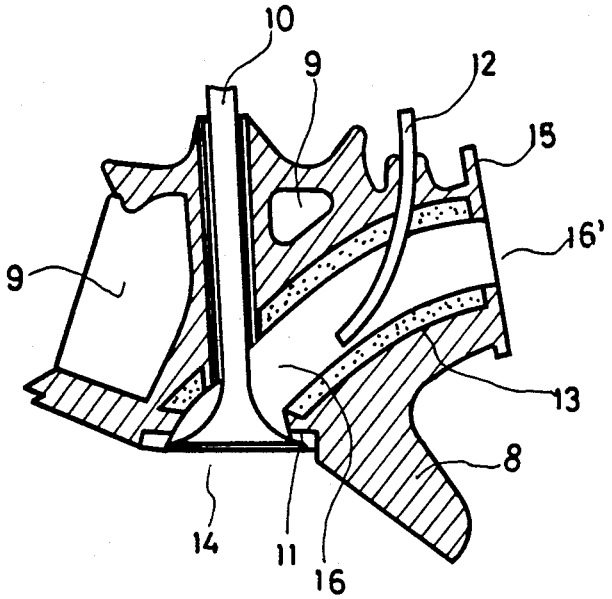
FIG. 5 is a sectional view taken through a cylinder head.

The cylinder head was constructed as shown in FIG. 5, in which 8 is the casting of the cylinder head (aluminum alloy or cast iron), 9 is the jacket for circulating the cooling water, 10 is the exhaust pipe, 11 is the valve seat, 12 is the air pipe, 13 is the ceramic pipe according to the present invention, 14 is the combustion chamber of the engine, and 15 is the flange for attaching the exhaust manifold.

In FIG. 5, the exhaust gas from the combustion chamber 14 of the engine is discharged through the exhaust port 16 fitted with the ceramic pipe 13 when the exhaust valve 10 opens. In the exhaust port 16, the air introduced through the air intake pipe 12 is mixed with the exhaust gas, so that the carbon monoxide and hydrocarbons in the exhaust gas are transformed into harmless carbonic acid gas and water. The gas purified in the exhaust port 16 passes out through the opening 16' into the manifold reactor (not shown). The purifying performance will be described in Examples 2 and 3. In the present example the vibration resisting properties and durability are described.

Table 18 gives the conditions of the endurance test and Table 19 summarizes the test results.

TABLE 18

| Items | Conditions |
|---|---|
| Displacement | Internal combustion engine mounted with aluminum cylinder head 1600 cc<br>Internal combustion engine mounted with cast iron cylinder head 2000 cc |
| Gasoline | Regular gasoline |
| Dynamo | D-C dynamo |
| Test procedure | Hot-cold test with 10 min of firing and 5 min of motoring at 5500 rpm |
| Test time | 100 hours |
| Secondary air volume | ~80 cc/engine revolutions |

TABLE 19

| Test No. | Ceramic pipe (Test results) | Test results: Engine A | Engine B |
|---|---|---|---|
| 1 | Test No. 10-A | X | X |
| 2 | Test No. 15-A | | |

TABLE 19-continued

| Test No. | Ceramic pipe (Test results) | Test results: Engine A | Engine B |
|---|---|---|---|
| 3 | Test No. 19-A | ○ | ○ |
| 4 | Test No. 28-A | ○ | ○ |
| 5 | Test No. 33-A | ○ | ○ |
| 6 | Test No. 35-A | X | X |
| 7 | Test No. 45-A | X | X |
| 8 | Test No. 48-A | ○ | ○ |
| 9 | Test No. 49-A | ○ | ○ |
| 10 | Test No. 53-A | X | X |

Note
1 Test No. indicated in the column of ceramic pipe means that with respect to the material quality, wall thickness and shape, the pipe is the same as the one bearing the same number in Tables 3–17; with respect to dimensions it is nearly the same as the one bearing the symbol A in Table 1.
2 Engine A is one equipped with an aluminum alloy cylinder head and Engine B is one equipped with a cast iron cylinder head.
3 In the test results the mark means nothing wrong and X means a broken ceramic pipe.

Comparing the results between Table 19 and Tables 3–17, it is seen that they correspond well. In short, the pipe that permits envelopment by a casting and can stand a vibrational acceleration of about 45 G is found to be capable of withstanding the endurance test on the engine stand.

EXAMPLE 2

The results of tests comparing the gas purification when a cylinder head with a casting-enveloped ceramic pipe is used and when one with a ceramic pipe which is not enveloped by a casting is used as mentioned in Example 1 will now be described.

Table 20 gives the test conditions and Table 21 summarizes the test results.

The results are indicated with the exhaust volume of CO, HC and $NO_x$ from the engine using a conventional cylinder head taken as 100.

TABLE 20

| Test conditions: Engine running conditions | Engine revolution (rpm) | Time (min.) |
|---|---|---|
| Start | 0 | |
| ↓ | ↓ | |
| Idle | 850 | 2 |
| ↓ | ↓ | ↓ |
| Accelerate | 2000 | 3 |
| ↓ | ↓ | ↓ |
| Accelerate | 4000 | 5 |
| ↓ | ↓ | ↓ |
| Decelerate | 2000 | 3 |
| ↓ | ↓ | |
| Stop | 0 | |

TABLE 21

| Engine revolution (rpm) | Exhaust gas purifying performance: components of exhaust gas CO (%) | HC (%) | $NO_x$ (%) |
|---|---|---|---|
| Ceramic pipe-fitted engine | 82 | 23 | 100 |
| Conventional engine | 100 | 100 | 100 |

As evident from the results given in Table 21, the effect in eliminating $NO_x$ is not significant, but the effect in eliminating HC is great and some CO as well can be removed.

In this test the air intake through the air pipe 12 was set at 80 cc per revolution of the engine and a ceramic pipe with the same material and wall thickness as the one in Test No. 28 and a shape similar to the one of symbol A was tested.

EXAMPLE 3

In Example 2 the exhaust gas purifying performance of a cylinder head with a casting-enveloped ceramic pipe was described. In Example 3, the exhaust gas purifying performance when a manifold reactor having a built-in ceramic pipe according to the present invention was connected to this cylinder head will be described.

Figure 6:
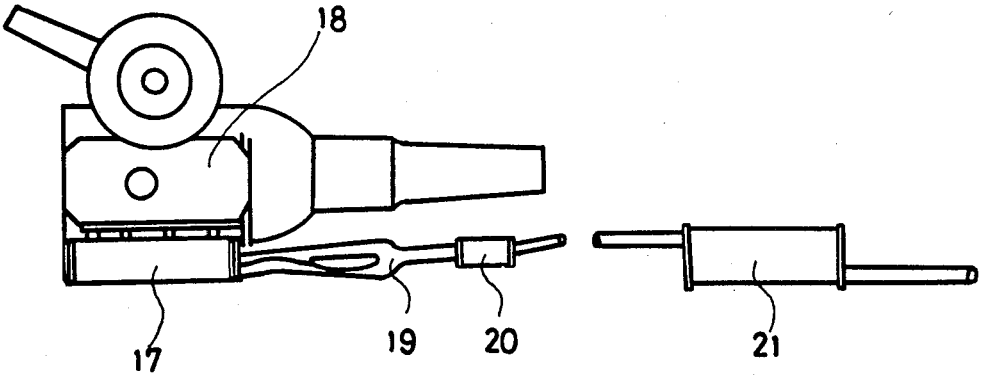
FIG. 6 shows the arrangement of an engine system.

The manifold reactor 17 is fitted into the engine system in an arrangement such as that illustrated in FIG. 6, in which reference numeral 18 indicates the engine, 19 the exhaust pipe, 20 the sub-muffler and 21 the main muffler.

Figure 7:
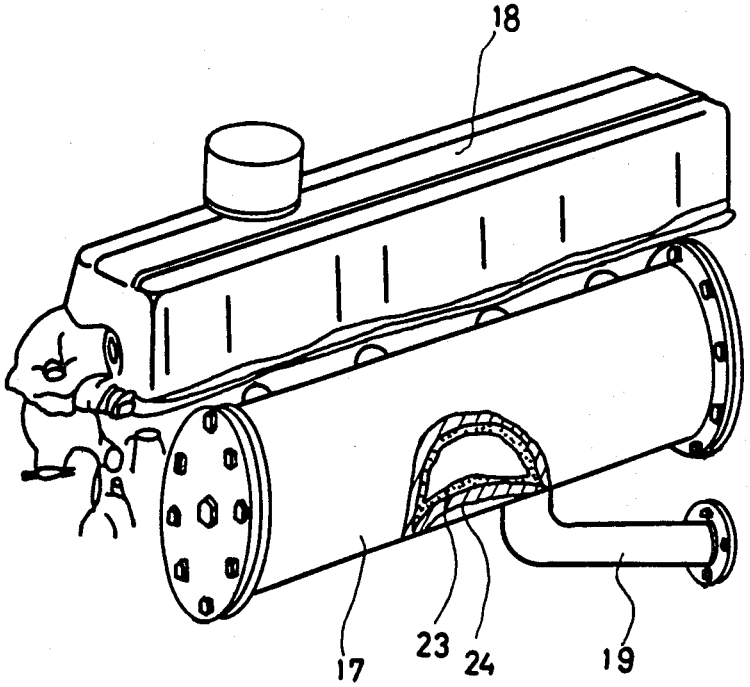
FIG. 7 is a partially cutaway oblique view of a manifold reactor.
Figure 8:
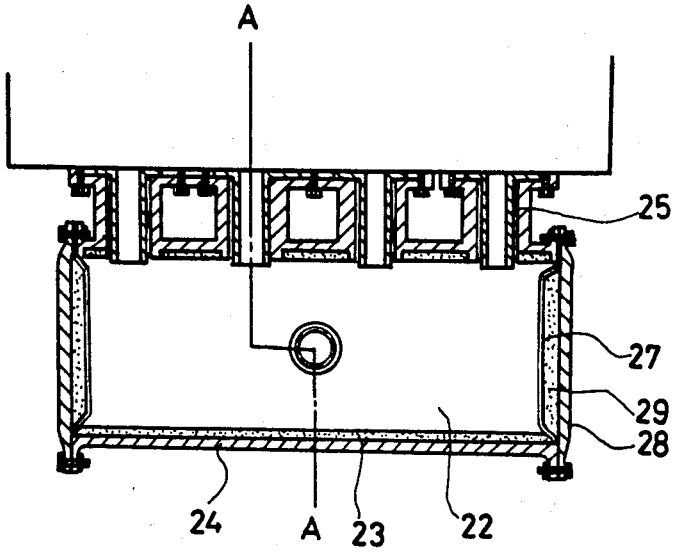
FIG. 8 is an axial sectional view taken through a manifold reactor.
Figure 9:
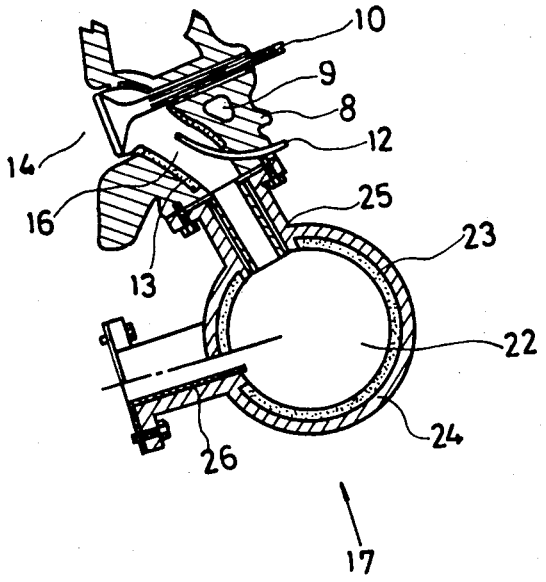
FIG. 9 is a sectional view taken along the line A—A of FIG. 8.

The structure of the manifold reactor is illustrated in FIG. 7, which is a partially cutaway oblique view of the reactor as attached to the engine 18. FIG. 8 is a sectional view thereof and FIG. 9 is a view taken along the A—A line in FIG. 8.

In FIGS. 7 and 8, 22 indicates the combustion chamber, 23 the ceramic pipe, 24 the outer casing, 25 the port liner to convey the exhaust gas from the cylinder head to the manifold reactor, and 26 the exhaust port liner to guide the reburnt gas to the exhaust pipe 19, for discharge.

As explained in Example 1, the exhaust gas burned in the combustion chamber 14 of the engine goes to the exhaust port 16, where it mixes with the air taken in via the air pipe 12, and the mixture is introduced through the port liner 25 into the combustion chamber 22 of the manifold reactor. In this chamber 22 the reburnable components (CO and HC) in the exhaust gas are reburnt and transformed into harmless $CO_2$ and $H_2O$. The exhaust gas is desirably kept as hot as possible and for this reason the part through which the exhaust gas passes is heat-insulated with a ceramic pipe.

In this example, the exhaust port 16 of the cylinder head 8 is heat-insulated by the ceramic pipe 13, while the combustion chamber 22 of the manifold reactor is heat-insulated by the ceramic pipe 23. Both ends of the ceramic pipe 23 for the manifold reactor are heat-insulated by a ceramic fiber sheet 29 sandwiched between the heat-resistant metal plate 27 and the end plate 28.

In this example, the ceramic pipe 13 for the cylinder head 8 was enveloped by a casting of aluminum alloy, JIS-AC8N, while the ceramic pipe 23 for the outer casing 24 of the manifold reactor 18 was enveloped by a casting of iron, JIS-FCG-23. The ceramic pipe 13 for the cylinder head is the same in material and wall thickness as and similar in shape to, the one used in Test No. 23-A of Table 8, while the ceramic pipe 23 for the manifold reactor is the same in material and wall thickness as, and similar in shape to, the one used in Test No. 22-C of Table 8.

An engine equipped with the above cylinder head and manifold reactor was subjected to an endurance test under the test conditions as listed in Table 18.

After testing, the exhaust port of the cylinder head was cut at four spots but examination revealed nothing wrong with the ceramic pipe 13. The manifold reactor was also cut and examined as shown in FIG. 8, but nothing wrong was revealed with the ceramic pipe 23.

Next the elimination of the harmful components (CO, HC, $NO_x$) exhausted from the system composed as above was checked by testing under the conditions listed in Table 20. The results are summarized in Table 22, in which the numerical values are indicated, taking as 100 the volume of the harmful components exhausted from a conventional engine system.

The results in Table 22 testify to the effectiveness of the system in this example.

TABLE 22

| Engine type | Exhaust gas purifying performance: Components of exhaust gas CO (%) | HC (%) | $NO_x$ (%) |
|---|---|---|---|
| System of the present invention | 15.4 | 12.3 | 100 |
| Conventional system | 100 | 100 | 100 |

EXAMPLE 4

A slurry was made by adding to ceramic (alumina) particles having cumulative particle size distribution No. 7 a 25% aqueous solution of polyvinylalcohol (PVA) in the amount of 15.5%. The slurry was poured into a gypsum mold to form ceramic pipes, which were dried at 100° C. for 5 hours, followed by firing at different temperatures. Using these pipes, casting-enveloping tests and vibration tests of the cast products were carried out. At the same time, using test specimens similar to the ones used in the preceding example, the bending strength was measured, the results being summarized in Table 23.

The results of Table 23 are approximately the same as those of Table 8 for the last example. They show that there is no difference between the performance of the ceramics according to Example 4 and that of an injection-molded product using a resin composition, so that the performance of the ceramics according to the present invention is satisfactory regardless of the molding process.

TABLE 23

Test results with cumulative particle size Distribution No. 7 (alumina ceramics, slurry-casting)

| Tests No. | Firing temperature and shrinkage: Firing temperature (°C.) | Linear shrinkage (%) | Bulk density (g/cm³) | Bending strength (Kg/cm²) | Ceramic pipe shape | Enveloping test results: Aluminum alloy | Cast iron | Vibration test results, Vibrational acceleration: 15 G | 30 G | 45 G |
|---|---|---|---|---|---|---|---|---|---|---|
| 54-A | 1350 | 0 | 2.51 | 101.2 | A | ◎ | ◎ | ○○ | ○○ | — |
| 54-B | | | | | B | ◎ | ◎ | ○○ | ○○ | — |
| 54-C | | | | | C | ◎ | ◎ | ○○ | Δ Δ | — |
| 54-D | | | | | D | ◎ | ◎ | ○○ | Δ × | — |
| 55-A | 1450 | 0 | 2.51 | 167.2 | A | ◎ | ◎ | ○○ | ○ ○ | ○ ○ |
| 55-B | | | | | B | ◎ | ◎ | ○○ | ○ ○ | ○ ○ |
| 55-C | | | | | C | ◎ | ◎ | ○○ | ○ ○ | ○ ○ |
| 55-D | | | | | D | ◎ | ◎ | ○○ | ○ ○ | ○ ○ |
| 56-A | 1550 | 0 | 2.53 | 214.3 | A | ◎ | ◎ | ○○ | ○ ○ | ○ ○ |
| 56-B | | | | | B | ◎ | ◎ | ○○ | ○ ○ | ○ ○ |
| 56-C | | | | | C | ◎ | ◎ | ○○ | ○ ○ | ○ ○ |
| 56-D | | | | | D | ◎ | ◎ | ○○ | ○ ○ | ○ ○ |
| 57-A | 1600 | 0 | 2.52 | 262.8 | A | ◎ | ◎ | ○○ | ○○ | ○○ |
| 57-B | | | | | B | ◎ | ◎ | ○○ | ○○ | ○○ |
| 57-C | | | | | C | ◎ | ◎ | ○○ | ○○ | ○○ |
| 57-D | | | | | D | ◎ | ◎ | ○○ | ○○ | ○○ |

As described above, it is possible to obtain a ceramic pipe which may be enveloped in a casting of aluminum alloy or cast iron when the ceramics of the present invention are employed. The heat-insulated casting, i.e., the enveloped ceramic pipe according to the present invention has the merits of being highly effective in purifying the exhaust gas from auto engines and having excellent resistance to vibration.

In the conventional practice of heat-insulating a manifold reactor, a fibrous heat-insulating material was sandwiched in a heat-resistant metal cylinder, but when the ceramic pipe of the present invention is adopted, the structure can be simplified and the cost can be lowered. In a conventional heat-resistant metal cylinder which contains several welded spots, repetition of the cooling and heating cycle causes cracking of such spots and the fibrous heat-insulating material is liable to fly out through cracks into the exhaust gas. This difficulty is eliminated when the ceramics of the present invention are employed.

Moreover, the ceramics of the present invention may be used for both injection-molding and slurry-casting. Thus it is suitable for the mass production of intricate configurations and involves no difficulty in manufacture.

What is claimed is:

1. A vibration-resistant heat-insulating casting consisting essentially of (a) a ceramic part manufactured by molding particles of ceramic material having a cumulative particle size distribution within the shaded area indicated in FIG. 4 of the drawings as filed, and firing the molded ceramic, and (b) a metal cast around said ceramic part, said ceramic material being selected from the group consisting of alumina, cordierite, zirconia and glass ceramic and said casting metal being selected from aluminum alloy and cast iron.

2. The casting of claim 1, wherein said ceramic material is selected from alumina and cordierite.

3. The casting of claim 1, wherein said casting is in the form of a pipe.

4. A vibration-resistant heat-insulating casting consisting essentially of (a) a ceramic part manufactured by molding particles of ceramic material having a cumulative particle size distribution such that 14.5–50% of the particles are less than 44μ in size while the balance consists essentially of particles having a maximum particle size ranging between 500 and 2000μ, and firing the molded ceramic, and (b) a metal cast around said ceramic part, said ceramic material being one selected from the group consisting of alumina, cordierite, zirconia and glass ceramic and said casting metal being selected from aluminum alloy and cast iron.

5. The casting of claim 4, wherein said ceramic material is one selected from alumina and cordierite.

6. The casting of claim 4, wherein said casting is in the form of a pipe.

7. A vibration-resistant heat-insulating casting consisting essentially of (a) a ceramic part manufactured by molding particles of ceramic material having a cumulative particle size distribution such that 14.5–50% of the particles are less than 44μ in size and the balance consists essentially of particles having a maximum particle size of 500 to 2000μ, and firing the molded ceramic, and (b) a metal cast around said ceramic part, said ceramic material being alumina and said cast metal being selected from the group consisting of aluminum alloy and cast iron;

wherein, said casting is in the form of a pipe.

8. A method of making a vibration-resistant heat-insulating casting which comprises the steps of molding particles of ceramic material having a cumulative particle size distribution within the shaded area indicated in FIG. 4 of the drawings as filed, firing the molded ceramic, and then casting a metal around the resulting ceramic part, said ceramic material being selected from the group consisting of alumina, cordierite, zirconia and glass ceramic and said casting metal being selected from aluminum alloy and cast iron.

9. The method of claim 8, wherein said ceramic particles are compounded with a minor portion of resin prior to molding.

10. The method of claim 8, wherein said ceramic material is alumina and said molded ceramic is fired at a temperature of 1350° C. to 1750° C.

11. The method of claim 8, wherein said ceramic material is cordierite and said molded ceramic is fired at a temperature of 1150° C. to 1350° C.

12. The method of claim 8, wherein said particles of ceramic material are molded into the form of a pipe.

13. A method of making a vibration-resistant heat-insulating casting which comprises the steps of molding particles of ceramic material having a cumulative particle size distribution such that 14.5–50% of the particles are less than 44μ in size while the balance consists essentially of particles having a maximum particle size ranging between 500 and 2000μ, firing the molded ceramic, and then casting a metal around the resulting ceramic part, said ceramic material being one selected from the group consisting of alumina, cordierite, zirconia and glass ceramic and said casting metal being selected from aluminum alloy and cast iron.

14. The method of claim 13, wherein said ceramic particles are compounded with a minor portion of resin prior to molding.

* * * * *